US011360432B2

(12) United States Patent
Buehler et al.

(10) Patent No.: US 11,360,432 B2
(45) Date of Patent: Jun. 14, 2022

(54) RETROGRADE TOURBILLON OR KARUSSEL FOR TIMEPIECES

(71) Applicant: Harry Winston SA, Plan-les-Ouates (CH)

(72) Inventors: Johnny Buehler, Luins (CH); Emmanuel Bouchet, Saint Antoine (FR)

(73) Assignee: Harry Winston SA, Plan-les-Ouates (CH)

( * ) Notice: Subject to any disclaimer, the term of this patent is extended or adjusted under 35 U.S.C. 154(b) by 490 days.

(21) Appl. No.: 16/517,029

(22) Filed: Jul. 19, 2019

(65) Prior Publication Data

US 2020/0033807 A1 Jan. 30, 2020

(30) Foreign Application Priority Data

Jul. 24, 2018 (EP) ..... 18185167

(51) Int. Cl.
*G04B 17/28* (2006.01)

(52) U.S. Cl.
CPC ..... *G04B 17/285* (2013.01)

(58) Field of Classification Search
CPC ..... G04B 17/28; G04B 17/285; G04B 15/06
See application file for complete search history.

(56) References Cited

U.S. PATENT DOCUMENTS 7,527,423 B2 * 5/2009 Ruchonnet ..... G04B 17/285 368/127
10,481,557 B2 * 11/2019 Mutrux ..... G04B 17/285
2014/0126338 A1 * 5/2014 Forsey ..... G04B 17/285 368/127

(Continued)

FOREIGN PATENT DOCUMENTS

CH 709 331 A2 9/2015
CH 712 129 A2 8/2017

(Continued)

OTHER PUBLICATIONS

Office Action dated Jul. 21, 2020 in corresponding Japanese Patent Application No. 2019-114359 (with English Translation), 5 pages.

(Continued)

*Primary Examiner* — Sean Kayes
(74) *Attorney, Agent, or Firm* — Oblon, McClelland, Maier & Neustadt, L.L.P.

(57) ABSTRACT

A timepiece movement with a regulating member which is a tourbillon or carousel, also known as a karussel, and including a drive mechanism, with a pivoting arm subjected to the restoring torque of a first energy source and carrying a mechanism comprising a wheel, a second energy source that subjects to a restoring torque a third wheel set on which the wheel rolls, under the action of the first energy source, the structure carries stop means cooperating with complementary stop means of the third wheel set to hold the latter in position, which are uncouple-able under the action of uncoupling control means of the arm at the end of the forward angular travel of the arm to allow the third wheel set to pivot in a single direction under the action of the second energy source, causing a backward rotation of the arm to the start of its angular travel.

20 Claims, 4 Drawing Sheets

(56) References Cited

U.S. PATENT DOCUMENTS

| | | | | |
|---|---|---|---|---|
| 2016/0231708 | A1* | 8/2016 | Roth | G04B 13/008 |
| 2021/0026304 | A1* | 1/2021 | Buehler | G04B 45/0061 |

FOREIGN PATENT DOCUMENTS

| | | | |
|---|---|---|---|
| CN | 101458494 | A | 6/2009 |
| CN | 201402375 | Y | 2/2010 |
| CN | 104914707 | A | 9/2015 |
| CN | 206450978 | U | 8/2017 |

OTHER PUBLICATIONS

Combined Chinese Office Action and Search Report dated Nov. 20, 2020 in Patent Application No. 201910671796.6 (with English translation and English translation of Category of Cited Documents), 13 pages.

European Search Report dated Jan. 17, 2019 in European Application 181851676, filed on Jul. 24, 2018 (with English Translation of Categories of Cited Documents).

* cited by examiner

RETROGRADE TOURBILLON OR KARUSSEL FOR TIMEPIECES

CROSS-REFERENCE TO RELATED APPLICATIONS

This claims priority to European Patent Application No. 18185167.7, filed Jul. 24, 2018 and the entire contents of the above application is hereby incorporated herein by reference in entirety.

FIELD OF THE INVENTION

The invention concerns a timepiece movement comprising at least one resonator mechanism which is a tourbillon or a carousel, also known as a karussel, and comprising a timepiece drive mechanism, comprising a structure on which is pivotally mounted, about a main axis, an arm carrying a first mechanism, which is pivotally mounted on said arm about a first pivot axis remote from said main axis and includes a first wheel pivotally mounted about said first pivot axis or a pivot axis that is parallel thereto, said arm being subjected to the restoring torque of a first energy source, said drive mechanism further including at least a second energy source arranged to subject to a restoring torque a third wheel set comprised in said drive mechanism, directly, or indirectly via a second wheel set pivotally mounted about a second pivot axis.

The invention concerns the field of timepiece drive mechanisms and the field of timepiece display mechanisms.

BACKGROUND OF THE INVENTION

Lovers of watch complications are appreciative of some animation or movement in the displays of a timepiece, which can be provided by retrograde display mechanisms, or tourbillon or similar mechanisms, which moreover ensure less sensitivity to position.

Splitting the displays is also appreciated and offers the dial or mechanism a new look.

Retrograde displays are generally limited to the driving of hands, or more rarely of discs.

It has never been possible to achieve retrograde driving of a tourbillon or karussel cage, since a cage cannot go backwards on its fixed wheel and always has to rotate in the same direction. If an uncoupling system, using a cam or similar, is added in order to move the cage backwards, operation ceases during the backward motion, which is unacceptable.

CH Patent Application No. 709331A2 in the name of SEIKO INSTR. discloses a display mechanism which includes a cage unit including an escapement and a governor, and an operating unit configured to differentiate between the speed of motion of the cage unit with the passage of time and to move the cage unit in the direction toward or away from a first axis which is the centre of a particular display area, wherein the operating unit moves the cage unit such that the trajectory of movement, reproduced when the cage unit is moved in the direction toward the first axis which is the centre of the particular display area, is in continuity with the trajectory of movement reproduced when the cage unit moves in the direction away from the first axis which is the centre of the particular display area.

SUMMARY OF THE INVENTION

The invention proposes to develop a retrograde drive mechanism which is capable of carrying wheel sets having much higher inertia than the hands, particularly tourbillons or similar, and consequently to propose entirely novel displays.

To this end, the invention concerns a timepiece movement according to claim 1.

The invention also concerns a timepiece comprising at least one such drive mechanism.

BRIEF DESCRIPTION OF THE DRAWINGS

Other features and advantages of the invention will appear upon reading the following detailed description, with reference to the annexed drawings, in which:

FIG. 9 is a side view of this mechanism.

DETAILED DESCRIPTION OF PREFERRED EMBODIMENTS

Figure 1:
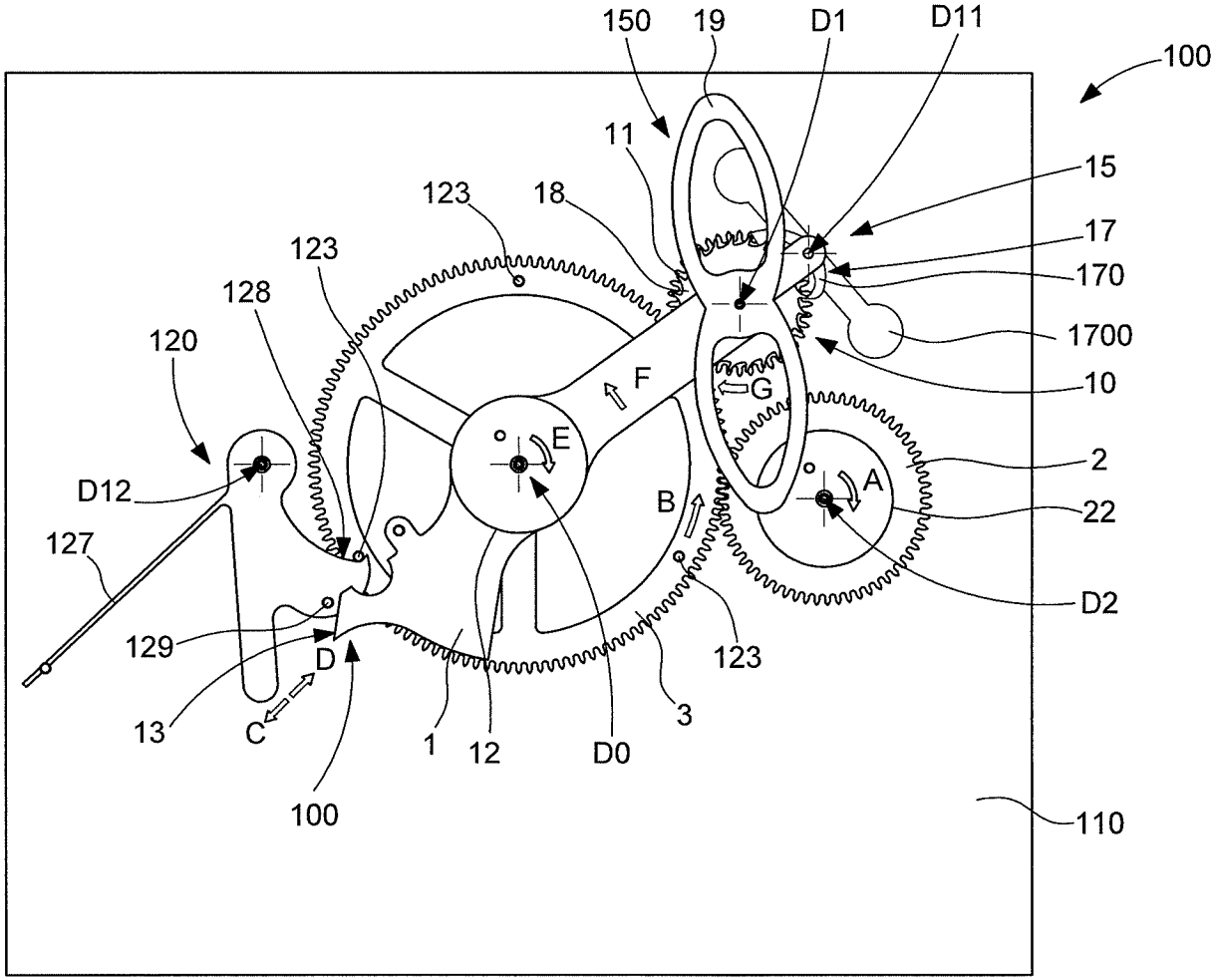
FIG. 1 represents a partial, schematic, plan view of a timepiece movement according to the invention.

The invention concerns a timepiece movement 500 comprising at least one regulating member 15 which is a tourbillon 150 or a karussel, and comprising a timepiece drive mechanism 100, which has the advantage of being able to be used in a watch or in a static timepiece, with novel functionalities.

This drive mechanism 100 includes a structure 110, such as a plate, bridge or similar, on which is mounted an arm 1 pivoting about a main axis D0. This arm 1 carries a first mechanism, which forms a planetary gear 10, which is pivotally mounted on arm 1 about a first pivot axis D1, which is remote from main axis D0. This planetary gear 10 includes a first wheel 11, which is pivotally mounted about first pivot axis D1 or a secondary pivot axis D11 which is parallel thereto.

Arm 1 is subjected to the restoring torque of a first energy source 12, such as a barrel, a weight system, or otherwise.

Figure 2:
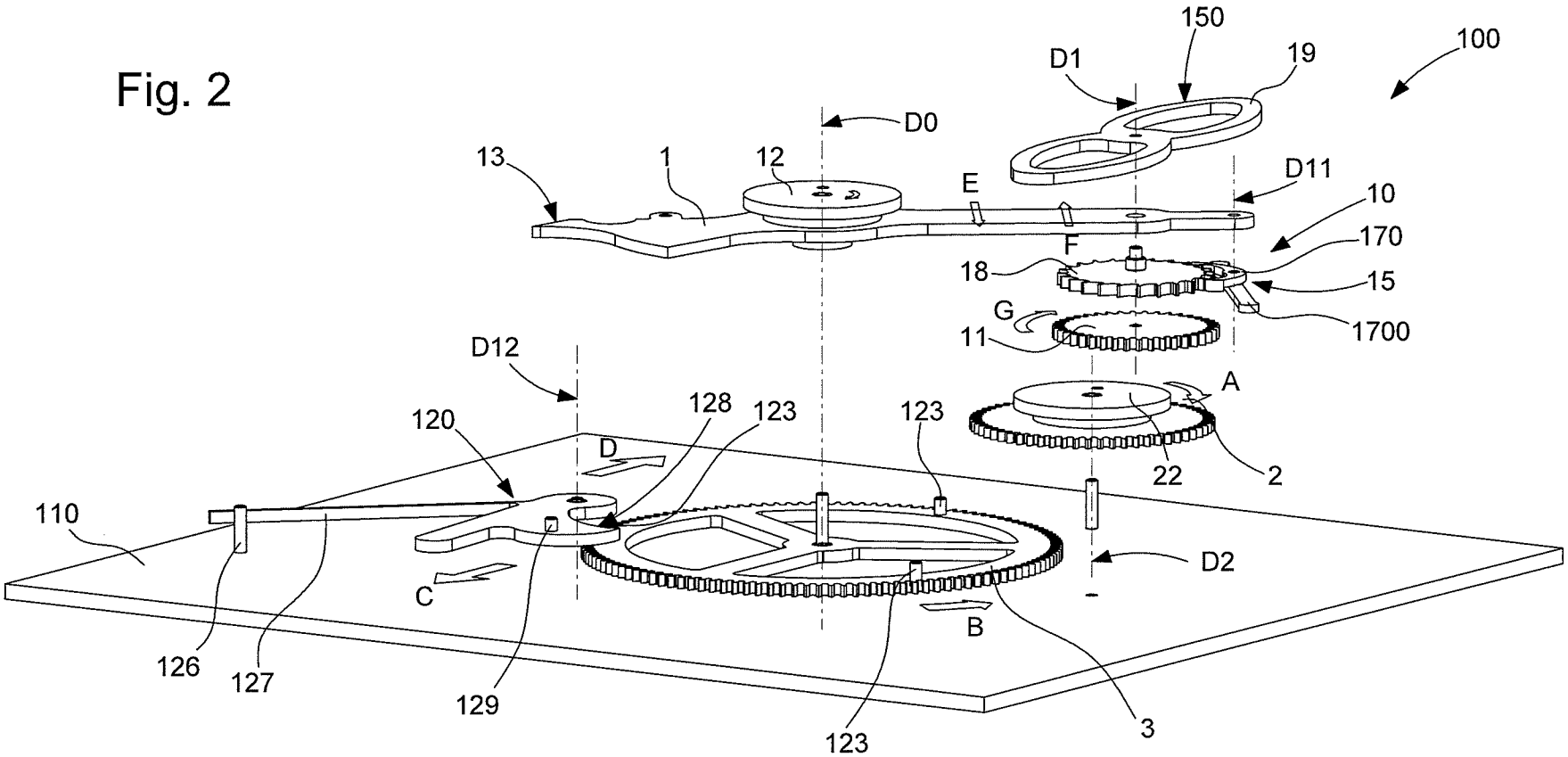
FIG. 2 represents a schematic, exploded perspective view of the movement of FIG. 1.
Figure 3:
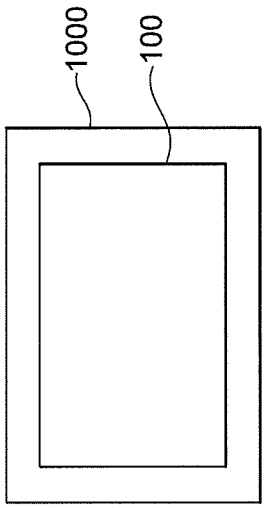
FIG. 3 is a block diagram representing a timepiece including such a movement.
Figure 4:
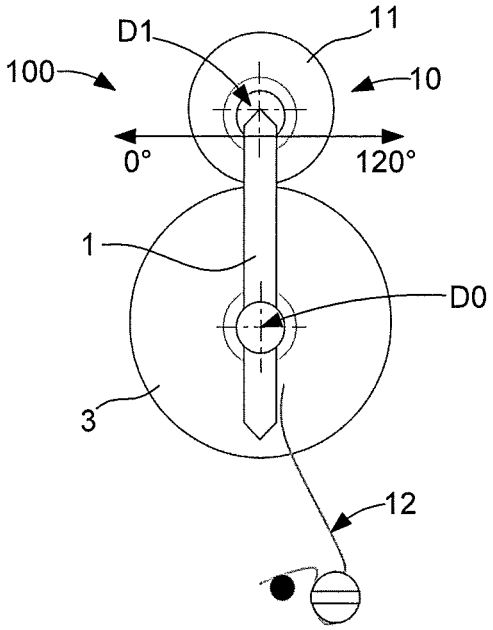
FIGS. 4 to 9 partially illustrate another variant, operating over an angular travel of 120° of the arm, as seen in a plan view in FIG. 4, as in FIGS. 5 to 8 which illustrate the positions of the wheel sets at different instants.

Drive mechanism 100 further includes at least a second energy source 22, which is arranged to subject to a restoring torque a third wheel set 3 comprised in drive mechanism 100, directly or indirectly via a second wheel set 2 pivotally mounted about a second pivot axis D2, as in the particular and non-limiting variant illustrated by FIGS. 1 and 2.

This second energy source 22 is the main energy source, and it is arranged to store more energy than first energy source 12.

First wheel 11 is arranged to roll over third wheel set 3 in a regularly advancing rolling motion, under the action of the restoring torque of first energy source 12.

Planetary gear 10 forms, therefore, a planetary wheel set, which moves in rotation about third wheel set 3, about main axis D0, always in the same direction, along arrow G (clockwise in FIG. 1), and at a constant speed.

According to the invention, third wheel set 3 is arranged to remain in a fixed position during a first basic travel of planetary gear 10, and to make a rotation, and in particular a rapid rotation, always in only one direction, that of anticlockwise arrow B in FIGS. 1 and 2, during a second basic travel of planetary gear 10, under the action of second energy source 22.

First wheel 11 drives tourbillon or karussel cage 150, or forms tourbillon or karussel cage 150.

Thus, with respect to fixed structure 110, arm 1 moves in the direction of arrow E under the action of first energy source 12 relative to third wheel set 3 when the latter is idle, whereas, during the return of third wheel set 3 under the action of second energy source 22, arm 1, which is carried by third wheel set 3, moves backwards in the direction of arrow F, with respect to fixed structure 110, during the second basic travel of planetary gear 10.

It is clear that planetary gear 10 permanently rolls around third wheel set 3, and that it continues to rotate with respect to third wheel set 3 during rotation of the latter. There is thus an alternation of first basic travels and second basic travels.

Owing to the successive rotations of the arm in the first direction of travel along arrow E, and in the second, reverse direction along arrow F, axis D1 makes a limited angular travel about main axis D0.

In a particular and non-limiting manner, the first basic travel of planetary gear 10 is very much greater than the second basic travel notably twenty times greater than the latter.

In the advantageous example illustrated by FIGS. 1 and 2, the complete cycle takes one minute, with fifty-eight seconds of slow speed movement of arm 1 in the first basic travel, and two seconds of rapid return of arm 1 in the second basic travel.

However, the invention makes it possible to modulate differently the ratio between the first part of travel and the second basic travel. It is, for example, possible to envisage obtaining a first basic travel and a second basic travel that are equal.

In the variant illustrated by FIGS. 1 and 2, in order to manage the rotational motion of third wheel set 3, drive mechanism 100 includes stop means 120, which are fixed to structure 110, and which are more particularly arranged to cooperate with complementary stop means 123 comprised in third wheel set 3 to hold it in position, or comprised in another external wheel set meshing directly or indirectly with third wheel set 3. Stop means 120 more particularly include a release lever, which is arranged to cooperate in succession with pins arranged over wheel set 3, and which form these complementary stop means 123, in the non-limiting example illustrated by FIGS. 1 and 2. In the illustrated example, these pins are angularly arranged in a regular manner. It is nonetheless possible to devise different angular spacings, to create particular displays.

These stop means 120 can be uncoupled, under the action of uncoupling control means 13 comprised in arm 1, when first wheel 11 finishes its first basic travel, to allow pivoting of third wheel set 3 in a single direction (anticlockwise arrow B) under the action of second energy source 22 causing a backward rotation of arm 1 to the start of its angular travel.

When third wheel set 3 is stopped in an angular stop position, first wheel 1 makes a first basic travel, and arm 1 moves in a forward angular travel at a slow speed which is its display speed. At the end of this first basic travel of first wheel 11, uncoupling control means 13 uncouple stop means 120, and third wheel set 3 is then free and subjected to the torque of second energy source 22, directly or via second wheel set 2, according to the chosen variant of construction. Third wheel set 3 then makes a rotation, and more particularly an abrupt and virtually instantaneous rotation, before returning to another angular stop position between another pin 123 and release lever 120. This rotation of third wheel set 3 causes arm 1 to return backwards to its start-of-angular-travel position, and in particular, in the illustrated case, at an accelerated speed which is much higher than its slow display speed.

In another variant, first wheel 11 is arranged to roll inside third wheel set 3. Many other configurations can be envisaged, especially as regards the relative positions of the various pivot axes, with cascades of suitable intermediate wheels.

Naturally, it is also possible to subject third wheel set 3 to the torque of at least a third energy source, for example in a direct mesh.

The operation of drive mechanism 100 is dependent on the level of energy available in second energy source 22. In the case where drive mechanism 100 is integrated in a watch, the second energy source is advantageously recharged by an automatic winding mechanism, not detailed here since it is known to those skilled in the art: first energy source 11 is permanently wound by the second energy source as long as the latter has sufficient energy, this first energy source 11 thus forms a buffer storage device, and the force driving planetary gear 10 by this first energy source 11 is thus a constant force mechanism, or more precisely a constant torque mechanism.

In the very compact variant illustrated by FIGS. 1 and 2, stop means 120 include a lever, which forms a release lever, and which is pivotally mounted on a lever axis D12, and which is returned in the direction of arrow D by elastic return means 127, such as a spring or suchlike. This lever carries a lever pin 129.

Arm 1 includes a ramp 13, which is arranged to cooperate with lever pin 129, at the end of the forward angular travel of arm 1, and to push the lever in the direction of arrow C, which obscures a lever beak having a bearing surface 128, which, until then was holding in position a stop pin 123 comprised in third wheel set 3 (which has three pins at 120° in the present case). Third wheel set 3 is then released, and can rotate, its previously immobilised pin 123 then being able to pass underneath arm 1. The position of pins 123 controls the release function; they ensure the precision and duration of one complete travel period.

Advantageously, arm 1 includes banking means 20, which tend to resist the drive torque of first energy source 12, and which are arranged to limit the rolling speed of first wheel 11. Indeed, anything that can slow down the system is advantageous, to obtain regular operation of the constant force mechanism formed by the invention.

More particularly, these banking means 20 are braking and/or friction and/or regulating means. They can include, in particular, aerodynamic braking means, eddy current braking means, or otherwise. For example, first wheel 11 can carry a seconds hand.

More particularly still, as in the non-limiting case illustrated by FIGS. 1 and 2, banking means 20 are means for regulating the rolling speed of first wheel 11 around third wheel set 3. The regulating mechanism is preferably in planetary gear 10 which forms a planetary wheel set.

As seen in a non-limiting variant illustrated by FIGS. 1 and 2, the means regulating the rolling speed of first wheel 11 about third wheel set 3 include a stop device 17, such as a lever or similar, and which is arranged to cooperate in a discontinuous manner with first wheel 11, or with a synchronous wheel set of first wheel 11, or with a fourth wheel set meshing directly or indirectly with first wheel 11.

In particular and as seen in FIGS. 1 and 2, the second pivot axis D2 is parallel to main pivot axis D0 and distinct therefrom.

In particular, and as seen in FIGS. 1 and 2, third wheel set 3 is arranged to pivot about main axis D0.

More particularly, planetary gear 10 forms all or part of banking means 20 and is a regulating member 15.

More particularly, regulating member 15 includes at least one inertia mass 1700 subjected to an alternating pivoting motion by pallets 170, comprised in stop device 17, and which is arranged to cooperate with a ratchet 18 driven directly or indirectly by first wheel 11.

More particularly, ratchet 18 is coaxial to first wheel 11.

More particularly, ratchet 18 is an escape wheel.

When regulating member 15 is a tourbillon 150, first wheel 11 drives the cage of tourbillon 150, or forms the cage of tourbillon 150. In this case, the axis of the resonator mechanism, typically a balance/balance spring, comprised in regulating member 15, coincides with first pivot axis D1.

When regulating member 15 is a karussel, first wheel 11 drives the karussel cage or forms the karussel cage. In such case, the axis of the resonator mechanism, typically a balance/balance spring, comprised in regulating member 15, is a secondary pivot axis, parallel to first pivot axis D1, for example located at the distal end of a governor 19, as illustrated in FIGS. 1 and 2.

More particularly, regulating member 15 includes a governor 19, which is driven directly or indirectly by first wheel 1.

More particularly, this governor 19 is synchronous with first wheel 11, and is able to form a first display of a first time magnitude.

More particularly still, governor 19 is a tourbillon or karussel cage.

Each wheel set of the drive mechanism of the movement according to the invention can be used for a particular display. Thus, more particularly, arm 1 forms or drives a display of a second time magnitude. This arm can carry off-centre displays, for example on stars pivotally mounted on arm 1.

Likewise, more particularly, third wheel set 3 forms or drives a display of a third time magnitude, for example a jumping minute display.

More particularly, second wheel set 2 forms or drives a power reserve display.

It is clear that this drive mechanism according to the invention makes possible a very lively display of the passage of time, through the clearly visible rolling of first wheel 11 on third wheel set 3, and by the periodic backward return of arm 1. Each wheel set can be used to carry an off-centre display.

The invention also concerns a timepiece 1000 including at least one such timepiece movement 500 and which, in a first variant, is a watch. It first energy source 12 and/or its second energy source 22 can include, in a conventional manner, at least one barrel and/or an electromechanical energy source or otherwise. Advantageously, second energy source 22 is recharged by an automatic winding mechanism.

In another variant, timepiece 1000 is static, and may, in particular, be a clock. It first energy source 12 and/or its second energy source 22 can include, in a conventional manner, at least one barrel and/or an electromechanical energy source or otherwise. Or its first energy source 12 and/or its second energy source 22 includes at least one weight, and this timepiece 1000 then includes means for winding each weight. However, preferably, first energy source 12 is a barrel forming a buffer storage device, which means that it is only necessary to wind second energy source 22, which powers first energy source 12.

Figure 5:
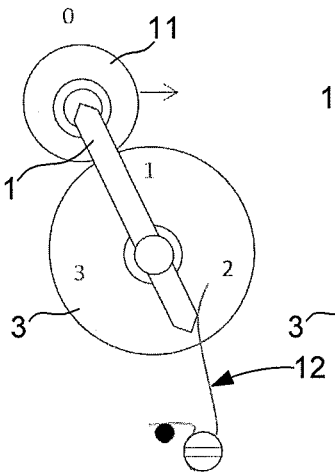
Figure 6:
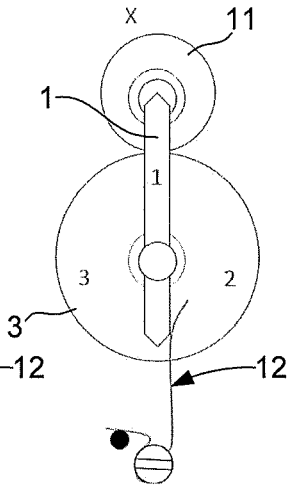
Figure 7:
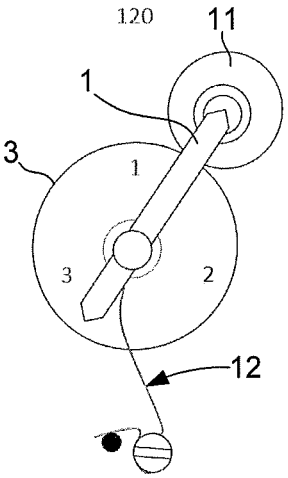
Figure 8:
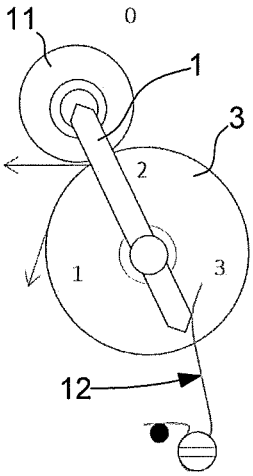
Figure 9:
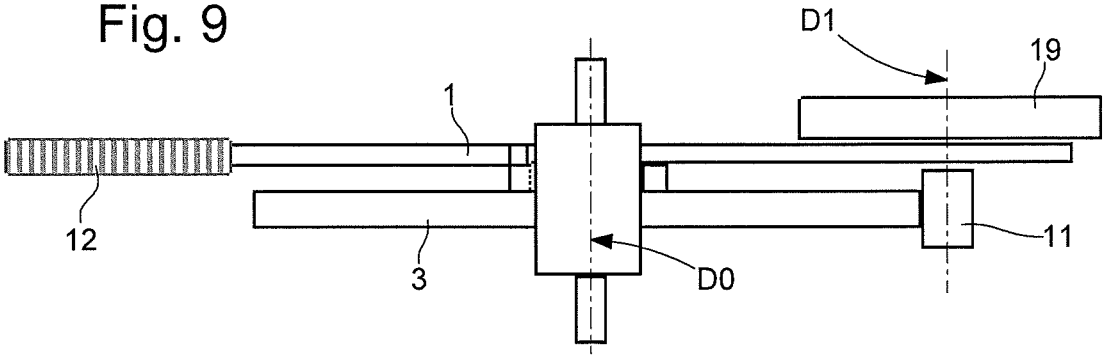

The principle of the invention is applicable to many other variants, and to numerous particular applications. This principle is illustrated, in a simplified manner in comparison to FIGS. 1 and 2, by FIGS. 4 to 9, which show only first energy source 12, illustrated in the form of a simple flat spring, arm 1 carrying first wheel 11 and third wheel set 3 on which first wheel 11 rotates. In this example, a tourbillon cage, carried by first wheel 11, makes one revolution per minute, first wheel 11 moves over third wheel set 3 for around 18 seconds when third wheel set 3 is still in a stationary position, and continues to roll over this third wheel set for the two seconds required for third wheel set 3 to return backwards 120° in the anticlockwise direction in these Figures. FIG. 5 shows the assembly in position immediately after such a backward return; FIG. 6 shows an intermediate position X; FIG. 7 shows the extreme angular position of the clockwise travel of arm 1, and FIG. 8 illustrates the backward return anticlockwise of the third wheel set (illustrated by the change of position of references 1, 2, 3) and of arm 1 which it carries.

Figure 10:
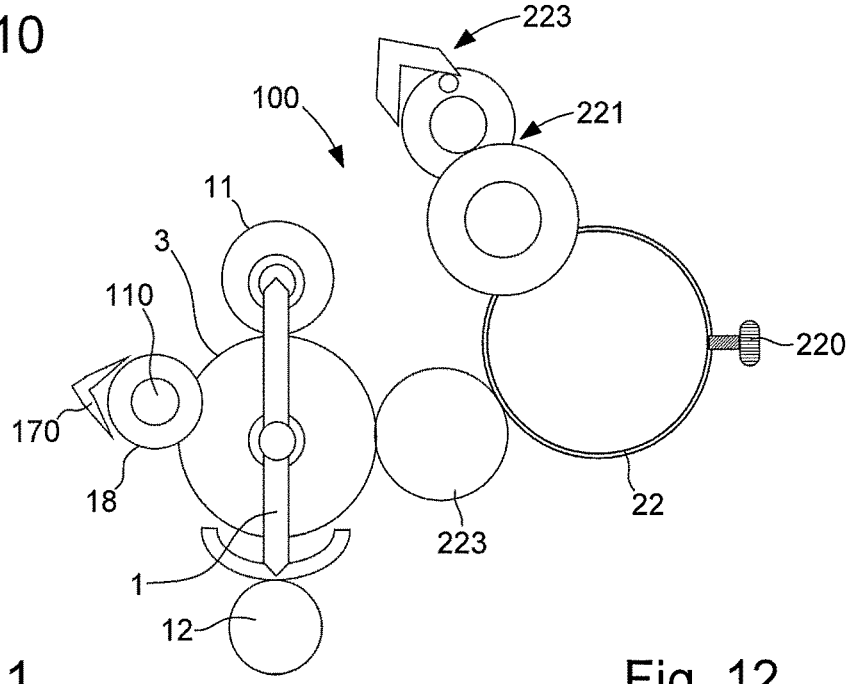
FIG. 10 represents a schematic, plan view of yet another variant of the mechanism according to the invention.

FIG. 10 illustrates yet another variant, with an arm 1 acting as winding rack on a winding barrel of the arm of the cage, forming first energy source 12, which drives cage arm 1; under the effect of its torque, the tourbillon cage is driven and makes its rotation on the circumference of third wheel set 3, arm 1 moves as a function of frequency and gear ratio. Arm 1 driving the cage moves from its first position of 0° and reaches its maximum position of 120°. At this instant, unlocking of second energy source 22 occurs, formed here by the barrel of a basic watch movement. This barrel is linked to a reduction wheel set 223, and the latter is connected to third wheel set 3. The force from movement barrel 22 will drive reduction wheel set 223 and consequently drive third wheel set 3 in a 120° rotation anticlockwise. The displacement in degrees of third wheel set 3 is controlled via a gear train 221 and positioned by a stop pin on a position bolt 223, this train 221 can be connected either to the reduction wheel set 223, or to the movement barrel 22. To manage the return over a duration of around 2 seconds, a governor with a reverser, notably including a pinion, a ratchet 18, pallets 170, is in series with third wheel set 3, and makes it possible to adjust the backward return duration, notably comprised between 1 and 10 seconds. During the 120° displacement of third wheel set 3, first energy source 12, which is the cage arm spring here, is wound again, the cage continues to operate by moving over the circumference of third wheel set 3. The variant of FIG. 10 controls the angular travel otherwise than by the pins 123 of the variant of FIGS. 1 and 2, which position train 221 replaces here. It is possible here to manage other angular values, for example 360°, to display a date change or otherwise.

It is noted that the barrel spring of the basic movement no longer interferes with the going train as in a conventional movement. Its only function now is to impart the impulse necessary to position third wheel set 3.

First energy source 12, which is the cage arm spring here, is preloaded with the torque necessary for operation of the tourbillon, this force will remain constant. The 120° angular, anticlockwise, rotational travel of third wheel set 3 winds the cage arm spring in a regular manner.

Figure 11:
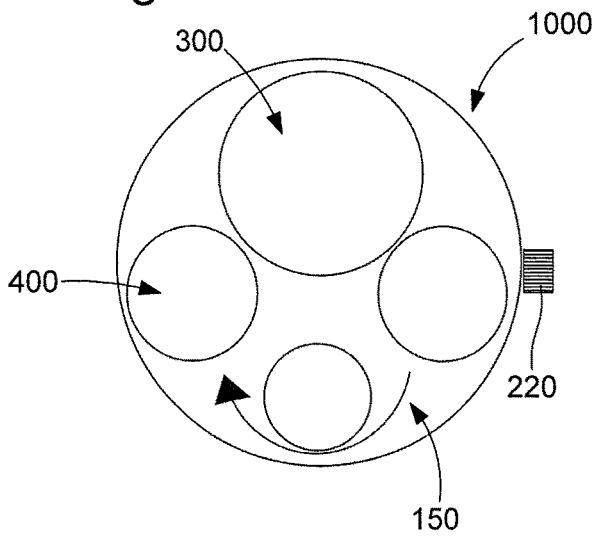
FIGS. 11 to 14 represent plan views of different arrangements of the mechanism according to the invention in a watch.
Figure 12:
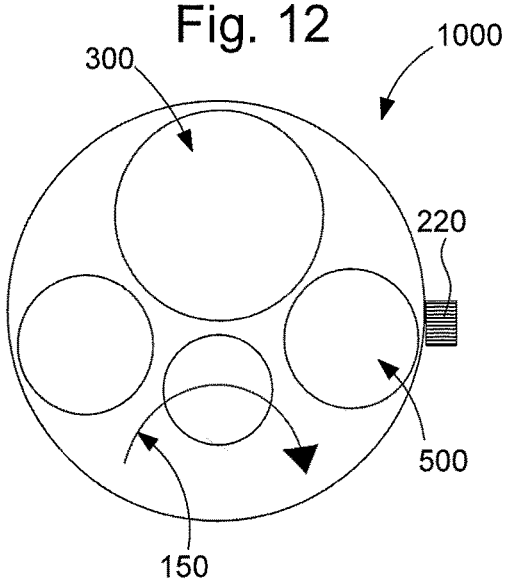
Figure 13:
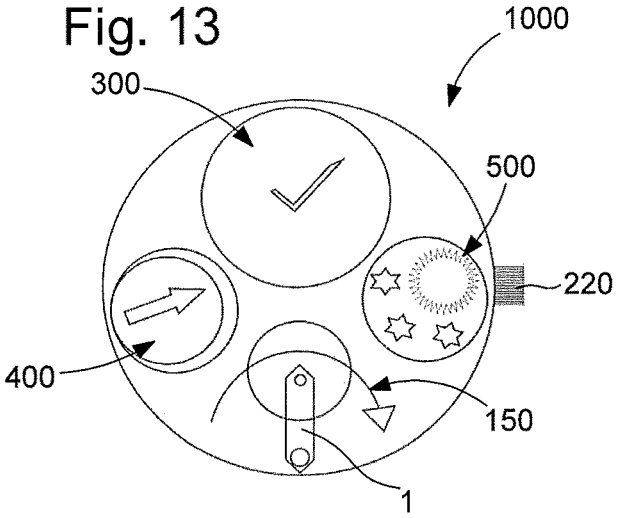
Figure 14:
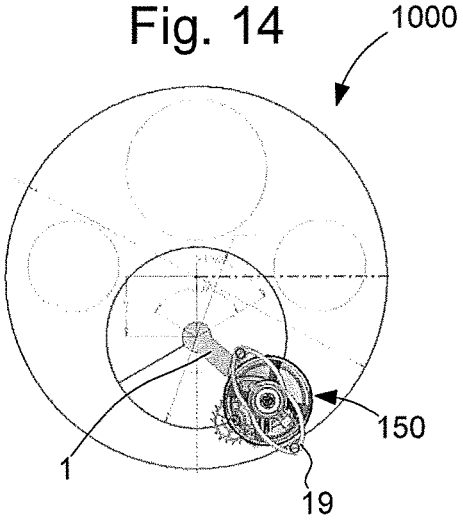

In this manner, it is possible to envisage developing several types of movement of the hour and minute hands, and complications like the moon and/or day/night and/or power reserve indications, as seen in FIGS. 11 to 13, in particular, on the return of the cage and the third wheel set, or with the position train where it is no longer necessary to use a cannon-pinion, and where the time-setting function is one-directional; or with the position train; with the position train and/or movement barrel the time-setting function is possible in both direction.

Winding occurs via crown 220, main barrel 22 will no longer interact with the going train as in the usual technique.

This arrangement also makes it possible to perform the moon correction directly using the crown, it is no longer necessary to incorporate a corrector integrated in the case middle.

It is clear that the invention ensures a virtually constant drive force for the regulating mechanism, notably a tourbillon or karussel cage, throughout the entire power reserve of the main barrel.

FIGS. 11 to 14 illustrate the broad scope offered by the invention for the positioning of the various displays. In the illustrated example, the hours and minutes are read on a dial at 12 o'clock, the power reserve on a sector with a retrograde hand at 9 o'clock, the moon and/or day/night, or sunset or other indications at 3 o'clock, while the tourbillon has a movement over 120°, and it is possible to orient the movement of the cage over 120° in a substantially peripheral motion as in FIGS. 11 and 14, or in a motion about an axis as far off-centre as possible, as in FIGS. 12 and 13, with a backward movement of the cage respectively from left to right, or from right to left.

The value of 120° used for the examples is not restrictive, the angular value depends on the desired time travel duration; the backward travel value is also adjustable, for example between 2 and 5 seconds, and allows a non-abrupt, shock-free, backward return to be obtained.

The backward return of the cage makes it possible to power the passage of the minutes The backward return is not linked to the frequency of the resonator mechanism and has no effect on the rate of the movement.

In other variants, it is possible to provide the third wheel set with several planetary gears 10 on its periphery. It is also possible to devise a system on several levels to manage distinct functions.

The invention claimed is:

1. A timepiece movement comprising at least one regulating member which is a tourbillon or carousel, and comprising a drive mechanism comprising a fixed structure on which is pivotally mounted, about a main axis, an arm carrying a planetary gear of the drive system comprised in said tourbillon or carousel, which planetary gear is pivotally mounted on said arm about a first pivot axis remote from said main axis and includes a first wheel pivotally mounted about said first pivot axis or a secondary pivot axis that is parallel thereto, said arm being subjected to the restoring torque of a first energy source, said drive mechanism further including at least a second energy source arranged to subject to a restoring torque a third wheel set comprised in said drive mechanism, directly, or indirectly via a second wheel set pivotally mounted about a second pivot axis, said first wheel being arranged to roll, under the action of said first energy source, over said third wheel set in a regular forward rolling motion with respect to the structure in a single direction of rotation, said third wheel set being arranged to remain in a fixed position during a first basic travel of said planetary gear, and, under the action of said second energy source, to make a rotation in only one direction during a second basic travel of the travel of said planetary gear, and during which said arm is carried by said third wheel set and moves backwards with respect to said fixed structure, and said first wheel driving the cage of said tourbillon or carousel or forming the cage of said tourbillon or carousel.

2. The timepiece movement according to claim 1, wherein said arm is arranged to move in a first direction with respect to said fixed structure under the action of said first energy source relative to said third wheel set when the latter is idle, and said arm, which is carried by said third wheel set, is arranged to move backwards in a second direction opposite to said first direction with respect to said fixed structure, during the return of said third wheel set under the action of said second energy source during said second basic travel of said planetary gear.

3. The timepiece movement according to claim 1, wherein said drive mechanism includes stop means arranged to cooperate with complementary stop means comprised in said third wheel set to hold it in position, or comprised in another external wheel set meshing directly or indirectly with said third wheel set, said stop means being able to be uncoupled, under the action of uncoupling control means comprised in said arm, when said arm reaches the end of its forward angular travel, to allow pivoting of said third wheel set in said second direction under the action of said second energy source causing a backward rotation of said arm to the start of its said angular travel.

4. The timepiece movement according to claim 1, wherein said arm includes banking means tending to resist the drive torque of said first energy source and arranged to limit the rolling speed of said first wheel.

5. The timepiece movement according to claim 4, wherein said planetary gear forms all or part of said banking means and is a regulating member.

6. The timepiece movement according to claim 5, wherein said regulating member includes a resonator mechanism with at least one inertia mass (1700) subjected to a pivoting alternating motion by pallets cooperating with a ratchet driven directly or indirectly by said first wheel.

7. The timepiece movement according to claim 6, wherein said ratchet is coaxial to said first wheel.

8. The timepiece movement according to claim 5, wherein said regulating member includes a governor driven directly or indirectly by said first wheel.

9. The timepiece movement according to claim 8, wherein said governor is synchronous with said first wheel and forms a first display of a first time magnitude.

10. The timepiece movement according to claim 8, wherein said governor is a tourbillon or carousel cage.

11. The timepiece movement according to claim 4, wherein said banking means are braking means and/or friction means and/or regulating means.

12. The timepiece movement according to claim 11, wherein said banking means are means for regulating the rolling speed of said first wheel about said third wheel set.

13. The timepiece movement according to claim 12, wherein said means regulating the rolling speed of said first wheel about said third wheel set include a stop device arranged to cooperate in a discontinuous manner with said first wheel or with a fourth wheel set meshing directly or indirectly with said first wheel.

14. The timepiece movement according to claim 1, wherein said second pivot axis is parallel to said main axis and distinct therefrom.

15. The timepiece movement according to claim 1, wherein said third wheel set is arranged to pivot about said main axis.

16. The timepiece movement according to claim 1, wherein said arm forms or drives a display of a second time magnitude.

17. The timepiece movement according to claim 1, wherein said third wheel set forms or drives a display of a third time magnitude.

18. The timepiece movement according to claim 1, wherein said second wheel set forms or drives a power reserve display.

19. The timepiece including at least one timepiece movement according to claim 1.

20. The timepiece according to claim 19, wherein said timepiece is a watch and in that said first energy source and/or said second energy source is a barrel.

* * * * *